United States Patent [19]

Moore

[11] Patent Number: 5,042,661

[45] Date of Patent: Aug. 27, 1991

[54] PACKAGE FOR CONTAINER ENDS

[75] Inventor: Ronald L. Moore, Golden, Colo.

[73] Assignee: Coors Brewing Company, Golden, Colo.

[21] Appl. No.: 568,402

[22] Filed: Aug. 16, 1990

Related U.S. Application Data

[62] Division of Ser. No. 426,807, Oct. 26, 1989, Pat. No. 4,967,537.

[51] Int. Cl.[5] ..... B65D 85/00

[52] U.S. Cl. ..... 206/445; 206/303; 206/484.1

[58] Field of Search ..... 206/303, 445, 484, 484.1, 206/499, 524.9; 220/553, 554

[56] References Cited

U.S. PATENT DOCUMENTS

| | | | |
|---|---|---|---|
| 2,802,568 | 8/1957 | Knox | 206/303 |
| 3,357,554 | 12/1967 | Walter | 206/303 |
| 3,686,820 | 8/1972 | Zenger et al. | 206/445 |
| 3,809,217 | 5/1974 | Harrison | 206/484 |
| 4,251,712 | 2/1981 | Parr | 206/484 |
| 4,433,783 | 2/1984 | Dickinson | 206/484 |
| 4,724,961 | 2/1988 | Shimoyamada et al. | 206/484.1 |

*Primary Examiner*—David T. Fidei

*Attorney, Agent, or Firm*—Klaas & Law

[57] ABSTRACT

A package for holding a plurality of containing ends having a volatile coating thereon which package is formed by superposing a first and a second elongated strip of a relatively flexible material so that a plurality of container ends may be inserted between the superposed strips and wherein portions of the superposed strips are then sealed together to form sealed compartments having the plurality of container ends confined therein and wherein the first elongated strip comprises a material for permitting passage of the airborne solvents therethrough to permit further processing of the container ends and at least the facing surface of the second elongated strip comprises a thermally reactive sealing material to form the sealed compartments.

4 Claims, 10 Drawing Sheets

PACKAGE FOR CONTAINER ENDS

This application is a division of application Ser. No. 426,807, filed 10/26/89, now U.S. Pat. No. 4,967,537.

FIELD OF THE INVENTION

This invention relates generally to the field of packaging and more specifically to the automated packaging of a plurality of articles having a uniform perimeter and a relatively small axial extent, such as ends for beverage containers.

BACKGROUND OF THE INVENTION

In the manufacture of containers such as aluminum soft drink and beer cans, the tops, or ends of the cans are manufactured in a stamping and scoring operation in a conversion press, where they are provided with beaded rims, "pop-tops", and so forth. The generally flat disc ends are then stacked face-to-face and packaged in paper bags. The bags facilitate transport and handling of the ends and protect them from dirt and other contaminants. The bags are fabricated from a one piece sheet of light weight paper material by joining opposite sides of the sheet to form an elongated tube large enough to enclose the stack of can ends. The bottom of the sheet is folded to form a flap extending radially outwardly from the stack and the top of the wrapper is folded to form a pair of ears extending longitudinally upwardly and radially outwardly from the stack. The wrapped end packages are transported to a seamer apparatus where the ends are joined to filled beverage containers.

In U.S. Pat. No. 3,686,820 to Zenger et al., there is disclosed a system for packaging ends for beverage containers wherein a plurality of ends are in sealed compartments which are interconnected. Zenger et al. employ two continuous strips of a plastic film which are heat sealed around a plurality of ends so that the sealed compartments are gas impervious. In many instances, the container ends are coated with a material during their manufacture and it is desirable to have air contact the container ends after they have been packaged so as to allow volatile portions of the coating to escape from the paper tube.

BRIEF DESCRIPTION OF THE INVENTION

This invention provides apparatus for packaging articles, such as ends for beverage containers, wherein a plurality of sealed interconnected compartments are formed and in each of which a plurality of the articles are confined and wherein at least a portion of each sealed compartment is formed from a material which permits the passage of a gaseous material, such as air or airborne solvents, therethrough.

In a preferred embodiment of the invention, there is provided a frame supported at a relatively fixed location and on which are mounted accumulating means for accumulating a plurality of articles and a transfer station for receiving accumulated articles from the accumulating means and transferring them to a packaging station. The accumulating means comprise three elongated cages having spaced apart parallel longitudinal axes. Each elongated cage has moving means for forming the articles into a desired number of accumulated articles and moving them into the transfer station. In the transfer station, there are three elongated cages, a central cage and first and second side cages, having spaced apart longitudinal axes and located to receive the accumulated articles from the accumulating means. The transfer station has first transfer moving means for moving the accumulated plurality of articles from the central elongated cage into a packaging station. The central elongated cage is rotatably mounted so that it can be rotated through ninety degrees. After the accumulated articles have been transferred from the central elongated cage to the packaging station, the central elongated cage is rotated ninety degrees and second transfer moving means move the accumulated articles from the first elongated side cage into the central elongated cage which is then rotated back through ninety degrees and the first transfer moving means moves the transferred accumulated articles into the packaging station. This process is repeated with the second elongated side cage. The packaging station has an elongated holding cage having a longitudinal axis with an entrance portion facing the central elongated cage and an exit portion facing in the opposite direction. The packaging station has first sealing means which comprise a pair of elongated bars which are mounted for movement in linear directions between an opened position and a closed position. A first continuous strip of a relatively flat flexible material is moved over one side of the elongated holding cage and a second continuous strip of a relatively flat flexible material is moved over the other side of the elongated holding cage so that the first and second continuous strips have facing inner surfaces and opposite edges. The first continuous strip comprises a kraft paper having a thermally reactive adhesive film as its inner surface and the second continuous strip comprises a kraft paper which permits the passage of a gaseous material, such as air or airborne solvents. In a preliminary operation, the first sealing means are moved to the closed position to seal together first superposed portions of the first and second continuous strips which are then moved to a location just outside of the exit portion so that portions of the first and second continuous strips overlie the one and the other sides of the elongated holding cage An accumulated plurality of articles are moved from the central elongated cage through the entrance portion of the elongated holding cage so as to be located between the portions of the first and second continuous strips As the accumulated plurality of articles are held in position within the elongated holding cage, the first sealing means are moved from an opened position to a closed position so as to form second superposed portions of the first and second continuous strips. At least one of the elongated bars is thermally heated so as to react the thermally reactive adhesive and seal together the second superposed portions The accumulated plurality of articles between the first and second sealed together superposed portions are then moved out of the exit portion toward a second sealing means and the opposite edges of the first and second continuous strips pass between crimping rollers to form third and fourth superposed portions of the first and second continuous strips which are then sealed by the second sealing means to form a sealed compartment having the accumulated plurality of articles confined therein. Control means are provided for operating the accumulating means, the transfer station and the packaging station so that a plurality of sealed compartments having an accumulated plurality of articles confined therein are formed. At periodic intervals, the transfer station does not move an accumulated plurality of articles into the packaging station so that one or more empty sealed compartments are formed which are used in a palletizing operation or which are cut in a cutting operation.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
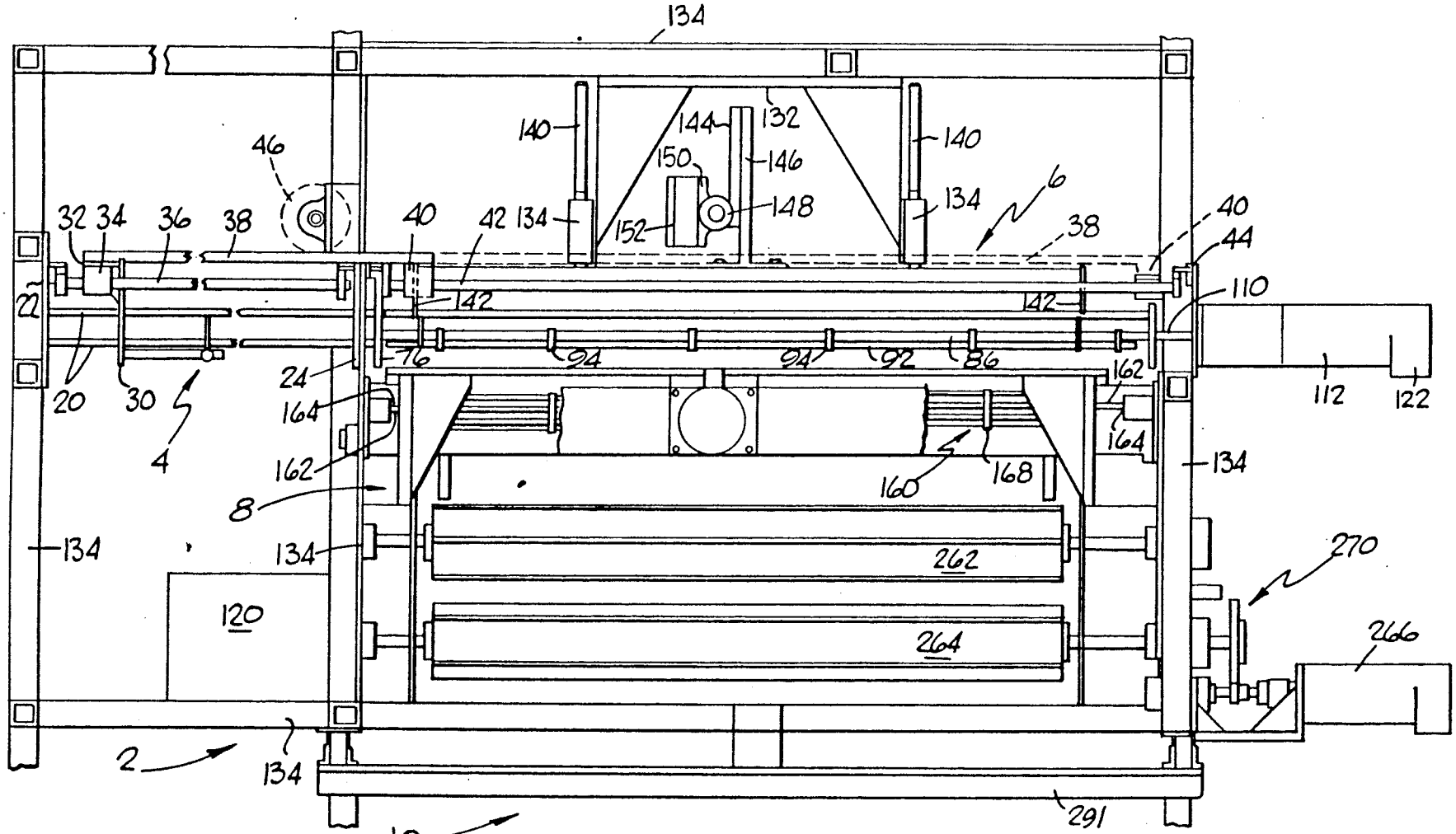
FIG. 1 is a front elevational view of a major portion of the apparatus of this invention.

In FIG. 1, there is illustrated apparatus 2 for packaging a plurality of articles, such as ends for beverage containers, wherein a plurality of sealed interconnected compartments are formed and in each of which a plurality of the articles are confined as described below. The apparatus 2 comprises an accumulating station 4, a transfer station 6, a packaging station 8, a cutting station 10 and a palletizing station 12, FIG. 3.

Figure 2:
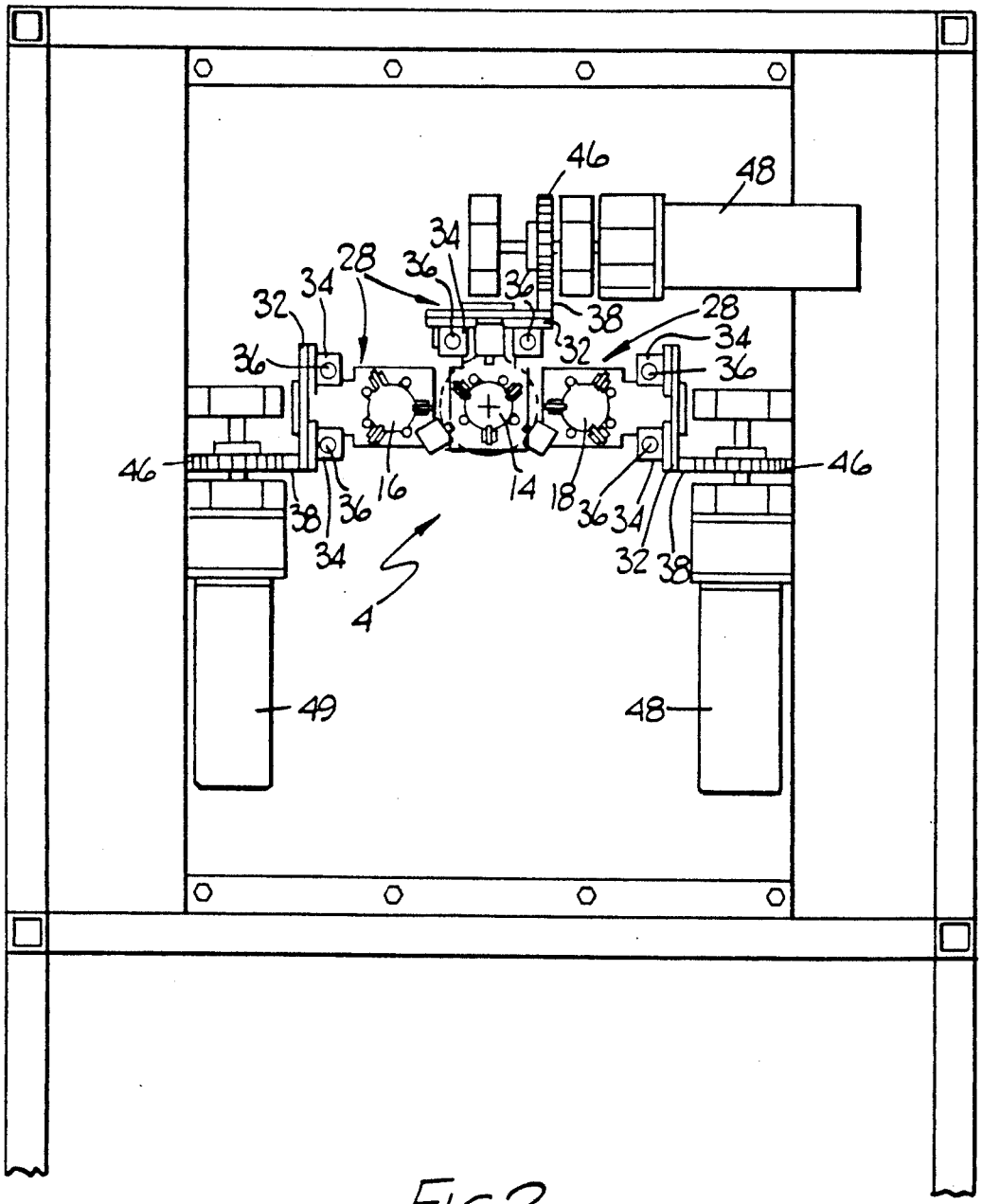
FIG. 2 is a side elevational view with parts removed from the left side of FIG. 1.
Figure 4:
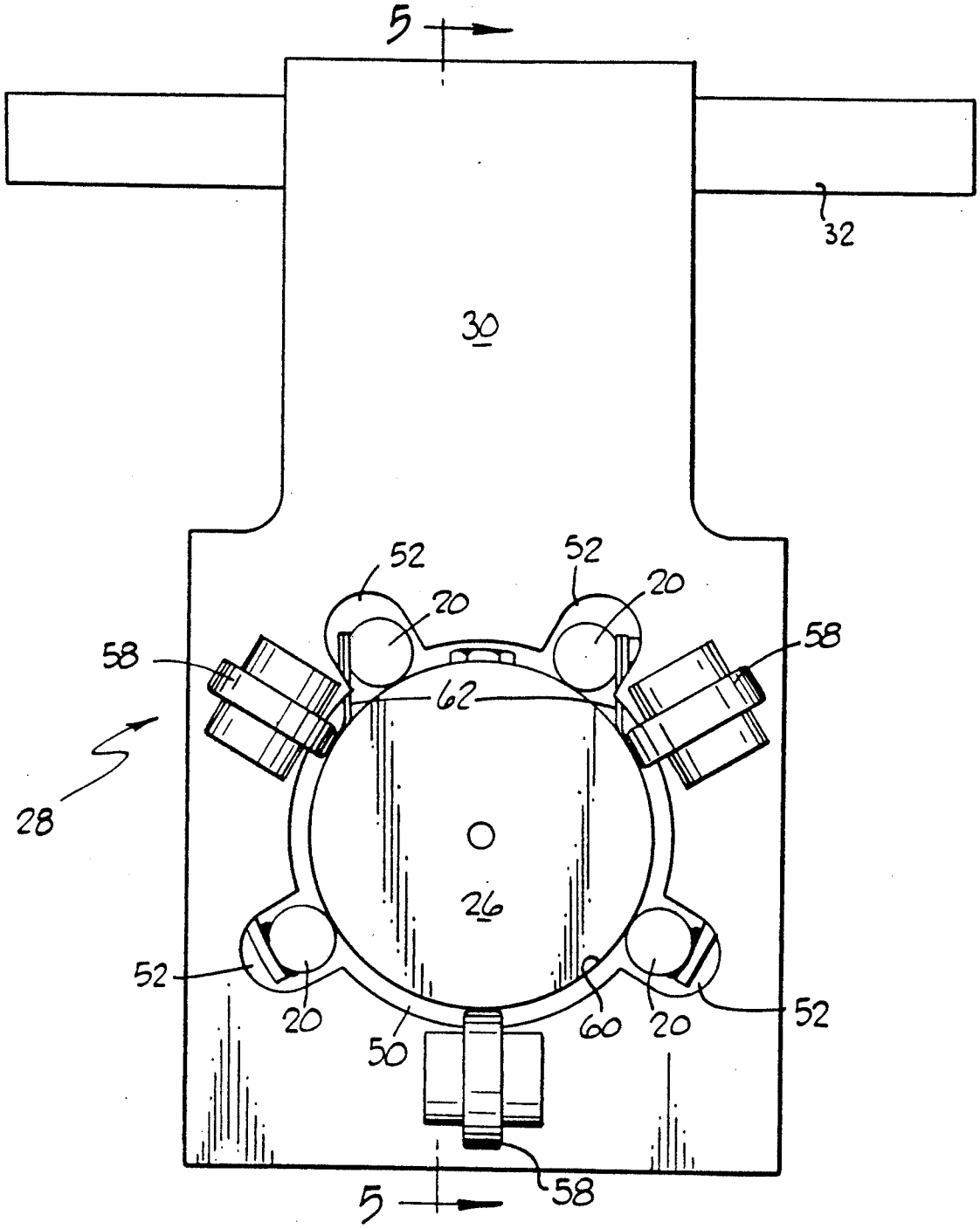
FIG. 4 is an enlarged view of one of the pusher assemblies of FIG. 2.
Figure 5:
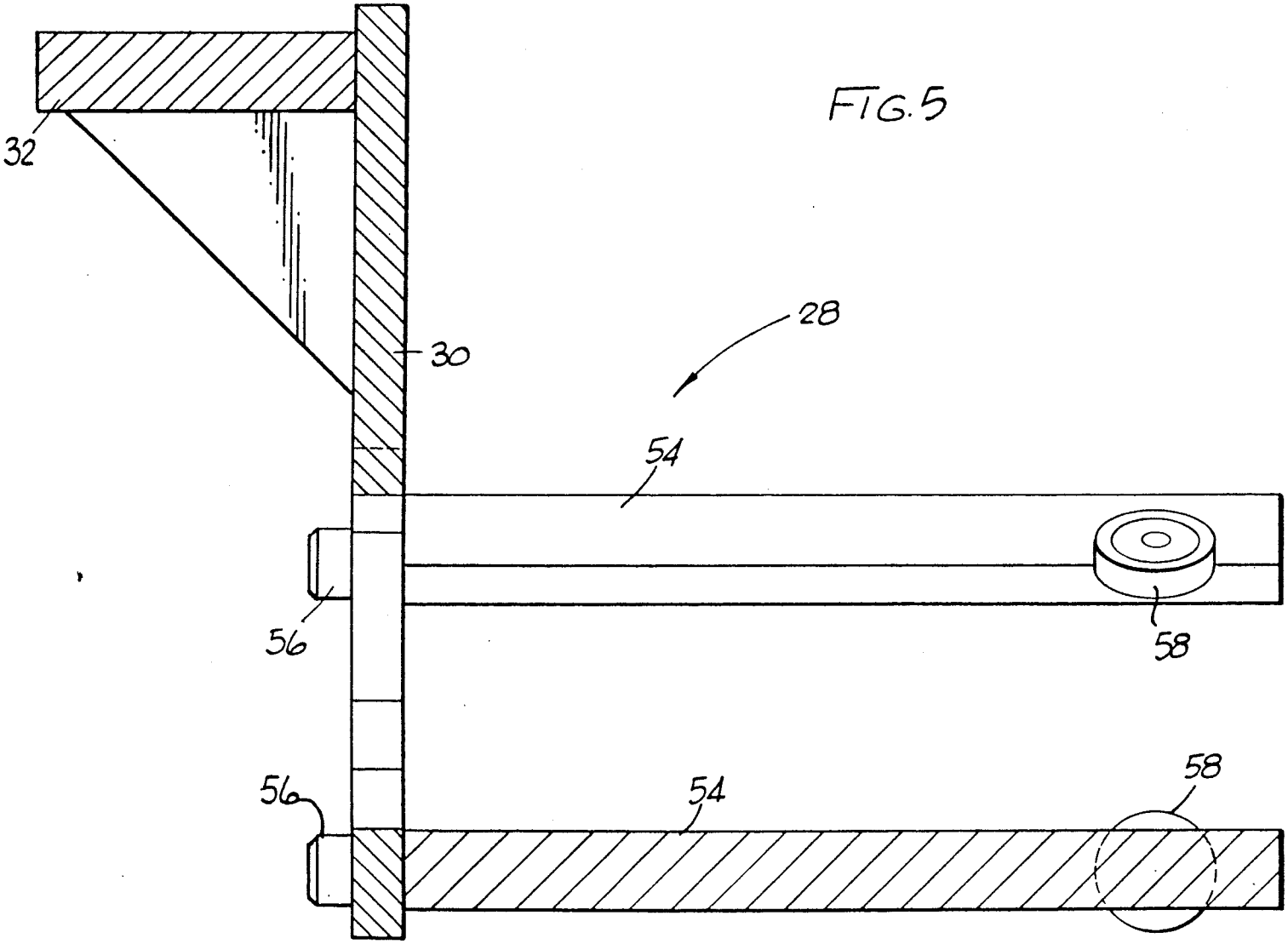
FIG. 5 is a cross-sectional view taken on the line 5—5 of FIG. 4.
Figure 14:
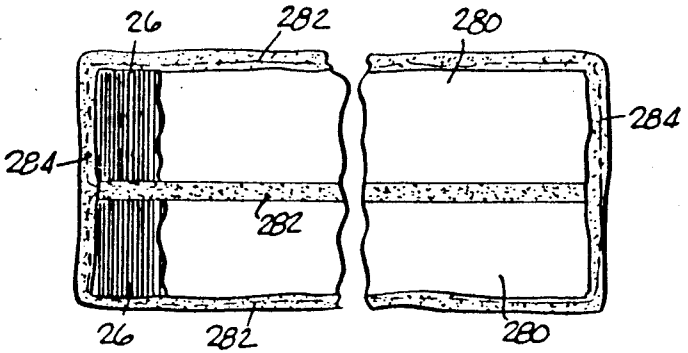
FIG. 14 is a top plan view of a portion of the product produced by this invention.

The accumulating station 4 is illustrated in FIGS. 2, 4 and 5 and comprises a central elongated accumulating cage 14 and first and second elongated accumulating side cages 16 and 18 all having longitudinal axes which are parallel to each other. Each of the accumulating cages comprises four rods 20 mounted in fixed supports 22 and 24, FIG. 1. Container ends 26 are fed by conventional means (not shown) into the accumulating cages 14, 16 and 18. Pusher assemblies 28 are provided for each of the accumulating cages 14, 16 and 18, each of which comprises a support plate 30 secured to a support beam 32 on which are mounted spaced apart bearing blocks 34 which are mounted for sliding movement over a pair of spaced apart shafts 36 mounted in the fixed supports 22 and 24. In FIG. 1, only the central rack 14 and pusher assembly 28 are illustrated. A rack 38 extends between and is mounted on the support beam 32 and a bearing block 40 which moves over a shaft 42 mounted on fixed supports 24 and 44. The rack 38 is operatively connected to a gear 46 which is driven by a motor 48 so as to reciprocate the rack 38 to move an accumulated plurality of container lids 26 from the accumulating cages 14, 16 and 18 into the transfer station 6. As illustrated in FIGS. 4 and 5, the support plate 30 has a central opening 50 having four cut out portions 52 to accommodate the rods 20 as the support plate 30 is reciprocated. Three support rods 54 project outwardly from the support plate 30 in a direction toward the transfer station 6 and are secured to the support plate 30 by headed bolts 56. A one way roller 58, capable of rotation only in one direction, is rotatably mounted on each support rod 54 and located to be in contact with the perimeters 60 of the container ends 26. One of the one way rollers is also a counter and as it is moved back in a direction away from the transfer station 6, counts the container lids 26 and stops when the predetermined number of container lids has been reached. The one way rollers 58 rotate as they move in the direction away from the transfer station 6 but are non-rotatable when moved in the direction toward the transfer station 6 so as to push the accumulated plurality of container lids 26 from the accumulating station 4 into the transfer station 6. Conventional rubber strips 62 are in contact with the perimeters 60 as the container lids 26 are being accumulated and moved.

Figure 7:
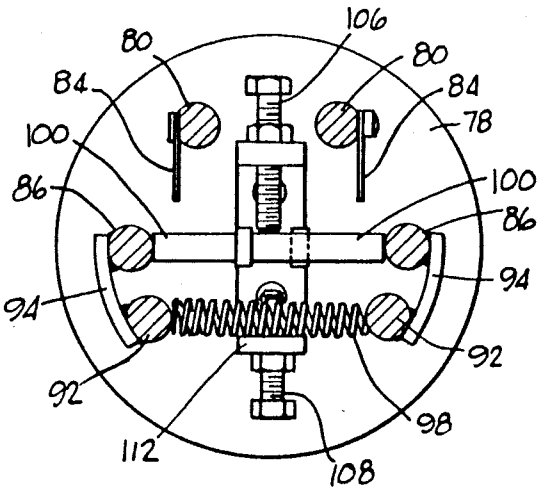
FIG. 7 is a cross-sectional view taken on the line 7—7 of FIG. 6.
Figure 6:
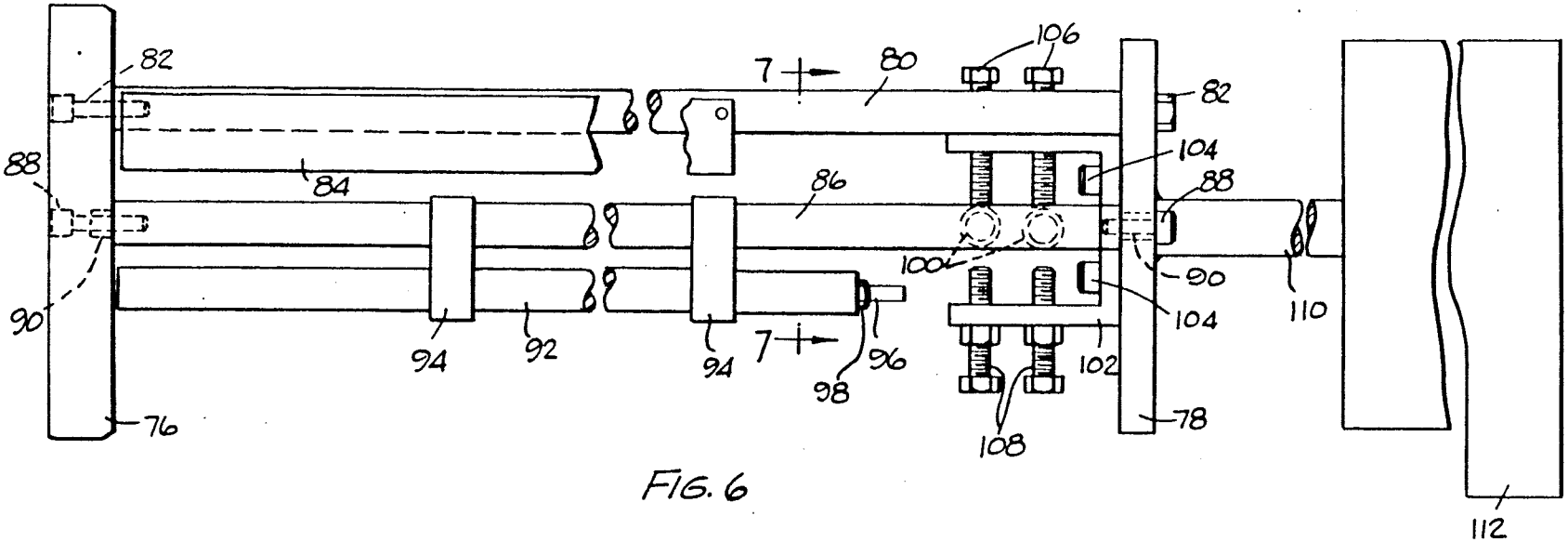
FIG. 6 is a front elevational view of the central cage of the transfer station.

The transfer station 6 is illustrated in FIGS. 1, 3 and 6-9 and comprises a central elongated transfer cage 70 and first and second elongated transfer side cages 72 and 74 (FIG. 3) all having longitudinal axes which are parallel to each other and aligned with the longitudinal axes of the accumulating cages 14, 16 and 18. In FIG. 1, only the central transfer cage 70 is illustrated and is more specifically illustrated in FIGS. 6 and 7. The central transfer cage 70 comprises a pair of spaced apart support members 76 and 78. A first pair of elongated rods 80 extend between and are fixedly secured to the support members 76 and 78 by threaded bolts 82. An elongated rubber strip 84 is mounted on each of the rods 80 and is adapted to contact the perimeters 60 of the container lids 26. A second pair of elongated rods 86 extend between and are rotatably mounted on the support members 76 and 78. A threaded bolt 88 is secured in each end of the rods 86 and is rotatably mounted in a bushing 90 mounted in the support members 76 and 78. A third pair of elongated rods 92 are mounted on the second pair of rods 86 by spaced apart arcuate strips 94 which are secured thereto by suitable means, such as by welding, so that when container lids 26 are moved into contact with the rods 92, the pair of rods 86 will rotate so that the rods 92 will move away from each other and allow the container lids 26 to pass between the rods 92. The facing surfaces of the rods 86 are spaced apart a distance slightly greater than the diameter of the container lids 26. Each of the rods 92 have a reduced end portion 96 and a spring 98 extends between and is connected to the end portion 96 and functions to hold the rods 92 in a closed position. Means are provided for limiting the rotational movement of the rods 92 and comprise a pair of spaced apart and outward projecting stop members 100 secured on the rods 86. A bracket 102 is mounted on the support member 78 by bolts 104. An upper pair of stop bolts 106 are adjustably mounted in the bracket 102 and are adapted to limit the rotational movement of the rods 86 by contact between the stop members 100 and the stop bolts 106. As illustrated in FIG. 7, the springs 98 urge the stop members 100 against the stop bolts 106 so that the rods 92 are in a closed position. A lower pair of stop bolts 108 are adjustably mounted in the bracket 102 and are adapted to limit the rotational movement of the rods 86 by contact between the stop members 100 and stop bolts 108. The stop bolts 108 are for safety purposes only and in normal operation are not contacted when the rods 92 are moved to an open position by the container lids 26. The support members 76 and 78 are mounted in fixed conventional bearings (not shown). A shaft 110 is secured to the support member 78 by suitable means, such as by welding, and is rotated through 90 degrees in clockwise and counter-clockwise directions by the motor 112 for purposes described below. Except for the rotational operation, the first and second side transfer cages 72 and 74 are constructed similar to the central transfer cage 70. The first and second side transfer cages 72 and 74 are located so that the opening between the rods 92 faces the central transfer cage 70.

Figure 8:
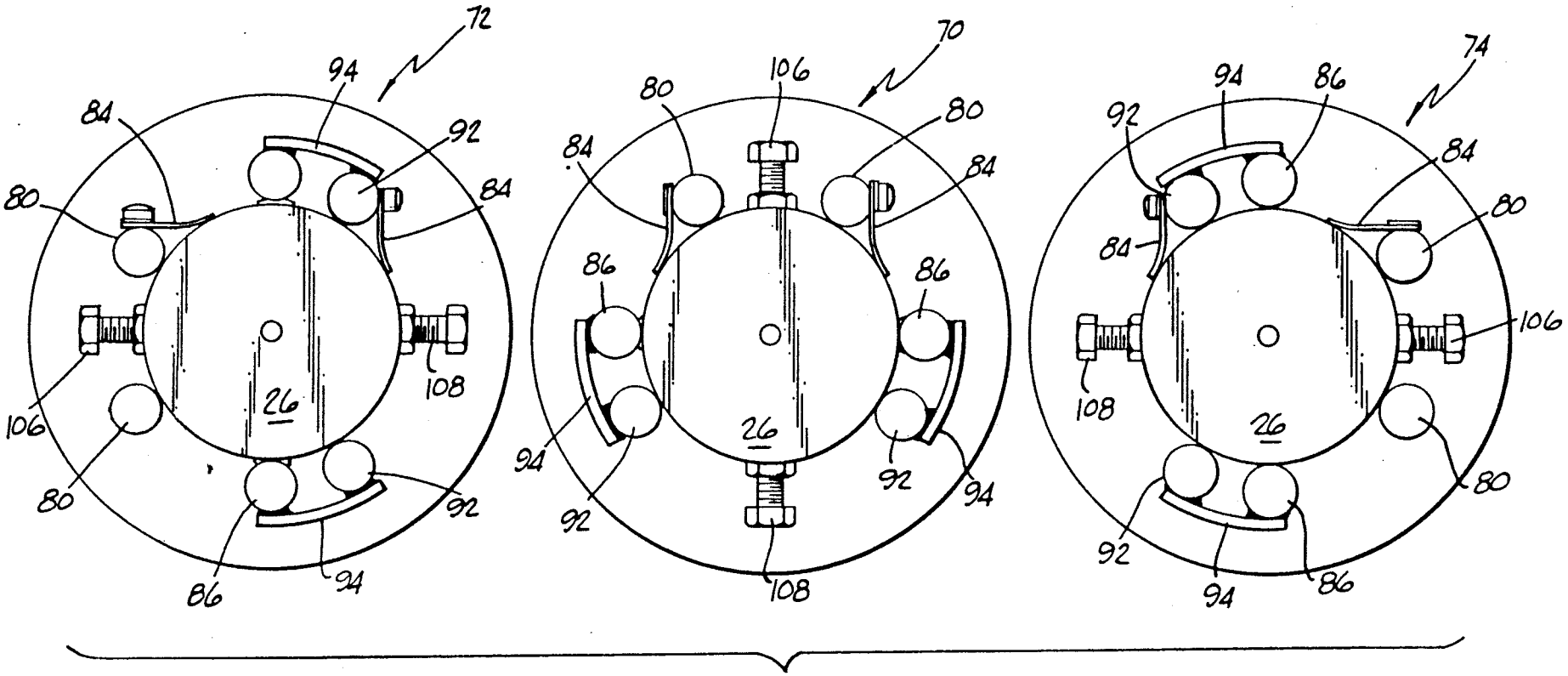
FIG. 8 is a schematic illustration of the transfer station.

The operation of the transfer station 6 is schematically illustrated in FIG. 8. The transfer cages 70, 72 and 74 are in the position illustrated in FIG. 8 when the accumulated container lids 26 are moved from the accumulating station 4 into the transfer station 6. Control means 120 are provided for operating the motors 48 to move the racks 38 substantially simultaneously so that the transfer cages 70, 72 and 74 receive accumulated container lids 26 at the same time. The rods 92 of the central transfer cage 70 face the packaging station 8. A pusher bar, described below, contacts the container lids 26 in the central transfer cage 70 and pushes them toward the packaging station 8. The container lids 26 apply a force on the rods 92 to overcome the force of the springs 98 so that the rods 92 move apart to permit the container lids to pass therebetween and thereafter the rods 92 are moved to a closed position by the springs 98, described above. Control means 120 rotates shaft 110 to rotate the central transfer cage 70 through 90 degrees in a clockwise direction so that the rods 92 of the central transfer cage 70 face the rods 92 of the side transfer cage 72. A pusher bar, described below, then applies a force to the accumulated container lids in the side transfer cage 72 to move them through both sets of rods 92 and into the central transfer cage 70 which is then rotated 90 degrees in a counter-clockwise direction and the accumulated container lids 26 are pushed out of the central transfer cage 70 to the packaging station 8 as described above. The central transfer cage 70 is then rotated through 90 degrees in a counter-clockwise direction and the accumulated container lids 26 in the side transfer cage 74 are moved into the central transfer cage 70 which is then rotated in a clockwise direction and the accumulated container lids are pushed out of the central transfer cage 70 to the packaging station 8 as described above.

Figure 3:
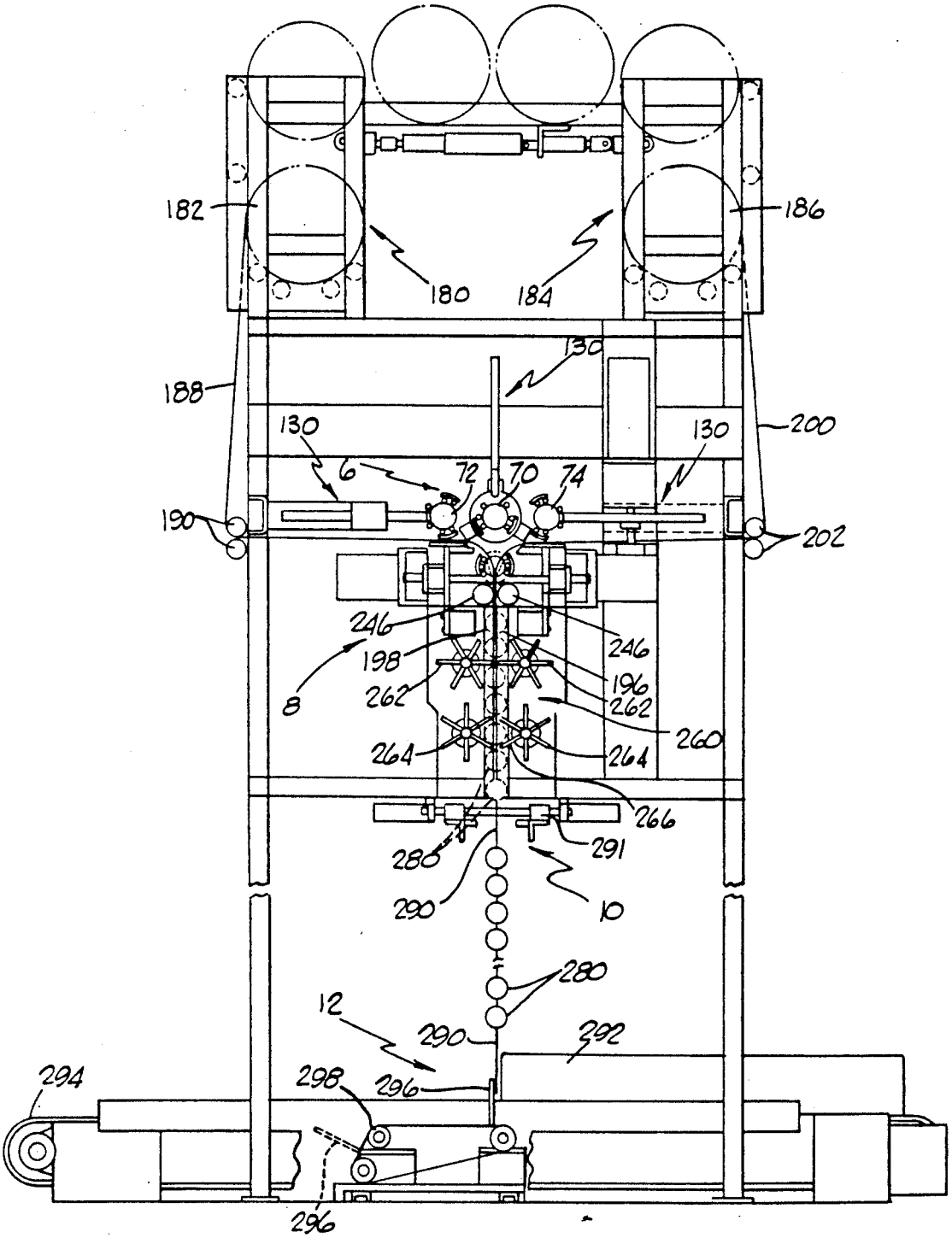
FIG. 3 is a side elevational view with parts removed from the right side of FIG. 1.
Figure 9:
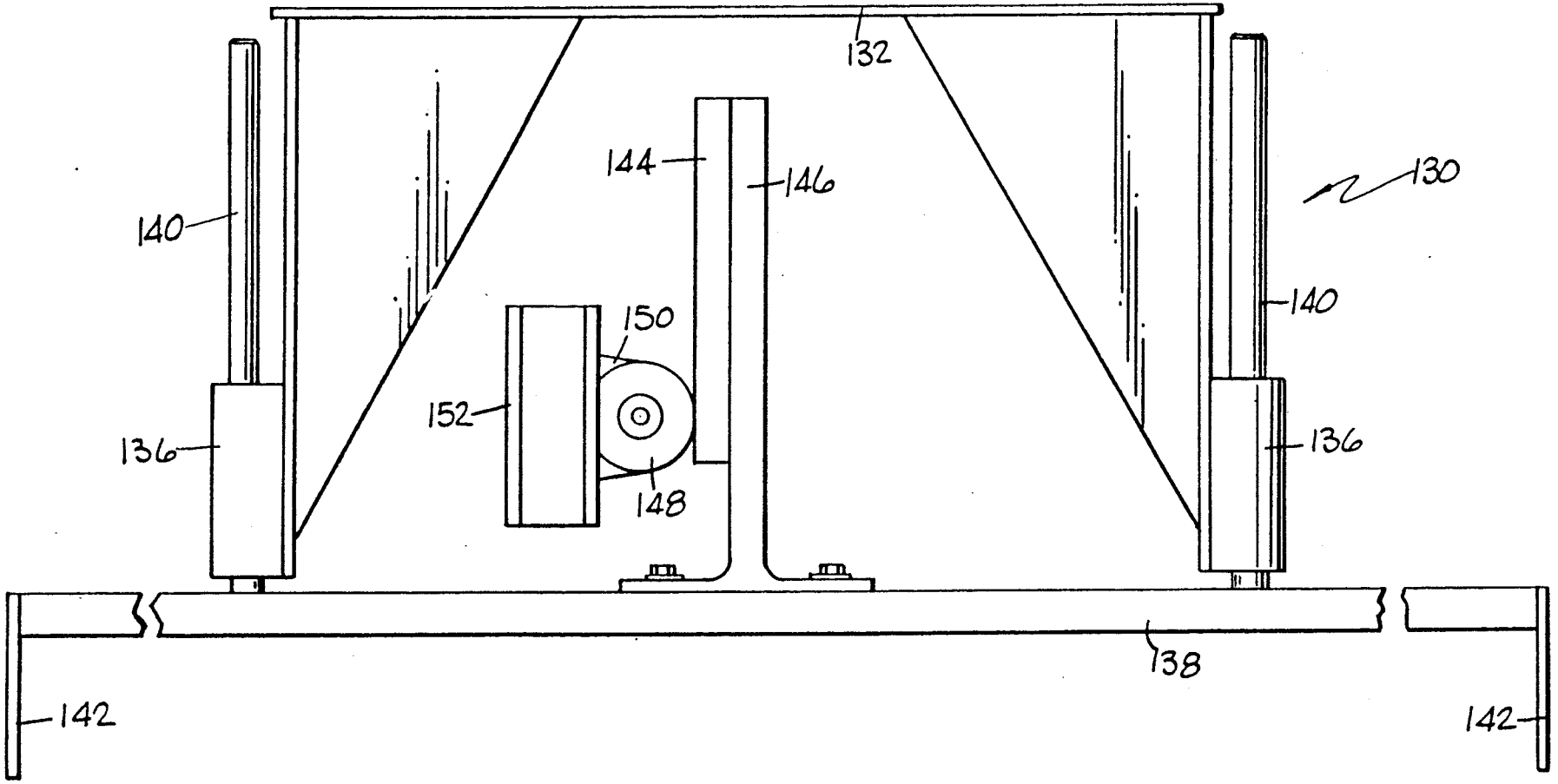
FIG. 9 is a front elevational view of one of the pusher rods for the transfer station.

The pusher bar assemblies 130 are illustrated in FIGS. 1, 3 and 9 and each comprises a support member 132 fixedly mounted on the main support frame 134 of the apparatus 2. A pair of spaced apart bearing sleeves 136 are fixedly mounted on the support member 132 by suitable means, such as by welding. A pusher bar 138 has a pair of spaced apart shafts 140 which pass through the bearing sleeves 136 to allow for sliding motion of the shafts 140. A pair of spaced apart arms 142 projects outwardly from the ends of pusher bar 138 and are adapted to contact the end container lid at each end of the accumulated container lids 26 in the transfer cages 70, 72 and 74. A rack 144 is mounted on the support 146 which is fixedly secured to the pusher bar 138. A gear 148 is in mesh With the rack 144 and is rotated by a motor 150 fixedly mounted on the support 152 which is fixedly mounted on the main support frame 134. Rotation of the gear 148 moves the pusher bar 138 to move the accumulated container lids 26 from the central transfer cage 70 to the packaging station 8 or from one of the side transfer cages 72 and 74 to the central transfer cage 70.

The packaging station 8 is illustrated in FIGS. 1, 3 and 10–14 and comprises a holding cage 160 having a longitudinal axis that is parallel to and aligned with the longitudinal axis of the central transfer cage 70. The holding cage 160 comprises a first opposite pair of elongated rods 162 which are rotatably mounted in fixed bearings 164 for rotation about its longitudinal axis. A second opposite pair of elongated rods 166 are mounted on the first pair of rods 162 by spaced apart arcuate strips 168 which are secured thereto by suitable means, such as by welding. The second pair of rods 166 form an entrance portion facing the central transfer cage 70. When the accumulated container lids 26 are being pushed out of the central transfer cage 70, they contact the second pair of rods 166 to apply a force thereto and rotate the first pair of rods 162 so that the second pair of rods 166 will move away from each other and allow the accumulated container lids 26 to pass between the second pair of rods 162. The second pair of rods 166 have reduced end portions 170. A spring 172 extends between and is connected to the reduced end portions 170 and functions to return the second pair of rods 166 to a closed position after the accumulated container lids 26 have passed therebetween. A third opposite pair of elongated rods 174 are mounted on the arcuate strips 168 by suitable means, such as by welding. The third pair of rods 174 form an exit portion for the accumulated container lids 26 after they have been partially confined as described below. The third pair of rods 174 are constructed similar to the second pair of rods 166.

Figure 12:
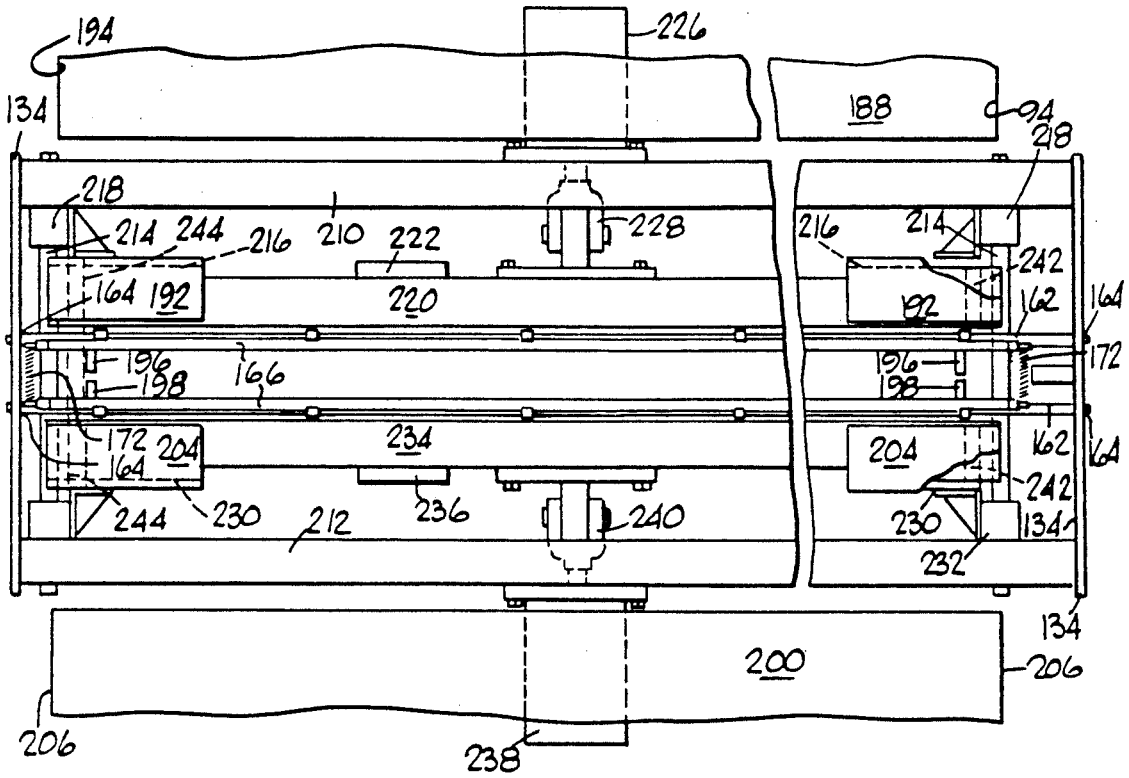
FIG. 12 is a top plan view of the packaging station.
Figure 13:
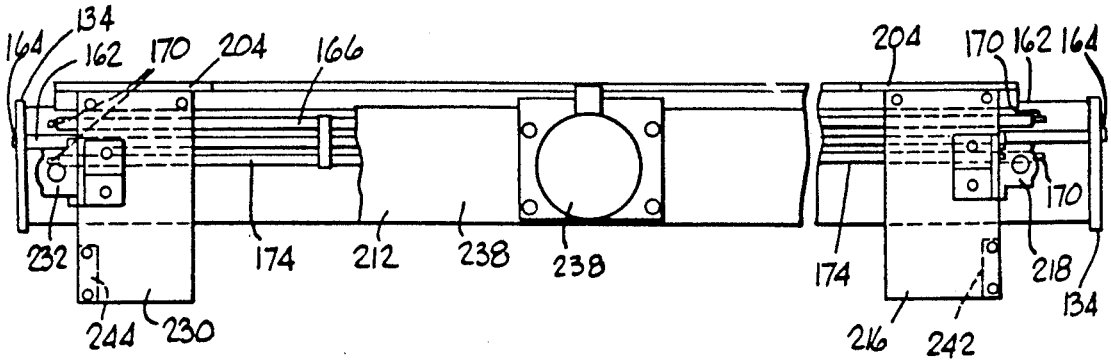
FIG. 13 is a front elevational view of FIG. 12.

In FIG. 3, there is illustrated first paper holder means 180 for holding a first roll 182 of a flexible relatively flat material, such as a kraft paper having a thermally reactive adhesive on one surface thereof, such as that marketed by Stone Container Corporation under the trade designation natural kraft/polylaminate and second holder means 184 for holding a second roll 186 of a flexible relatively flat material such as a kraft paper that is gas pervious, such as that marketed by Stone Container Corporation under the trade designation natural kraft. A first continuous strip 188 is removed from the first roll 182 and passes between feed rolls 190 and moves over the shelf means 192 and one of the second pair of rods 166. As illustrated in FIG. 12, continuous strip 188 has opposite edge portions 194 that, when moved over one side of the holding cage 160, are outside of the guide means 196 and 198 so that portions of the continuous strip 188 are between the guide means 196 and 198. A second continuous strip 200 is removed from the second roll 186 and passes between feed rolls 202 and moves over the shelf means 204 and the other of the pair of rods 166. The first continuous strip 188 has opposite edge portions 206 that, when moved over the other side of the holding cage 160, are outside of the guide means 196 and 198 so that portions of the continuous strip 200 are between the guide means 196 and 198. The location of the first and second continuous strips 188 and 200 prior to passing over the shelf means 192 and 204 is illustrated in FIG. 12.

Figure 10:
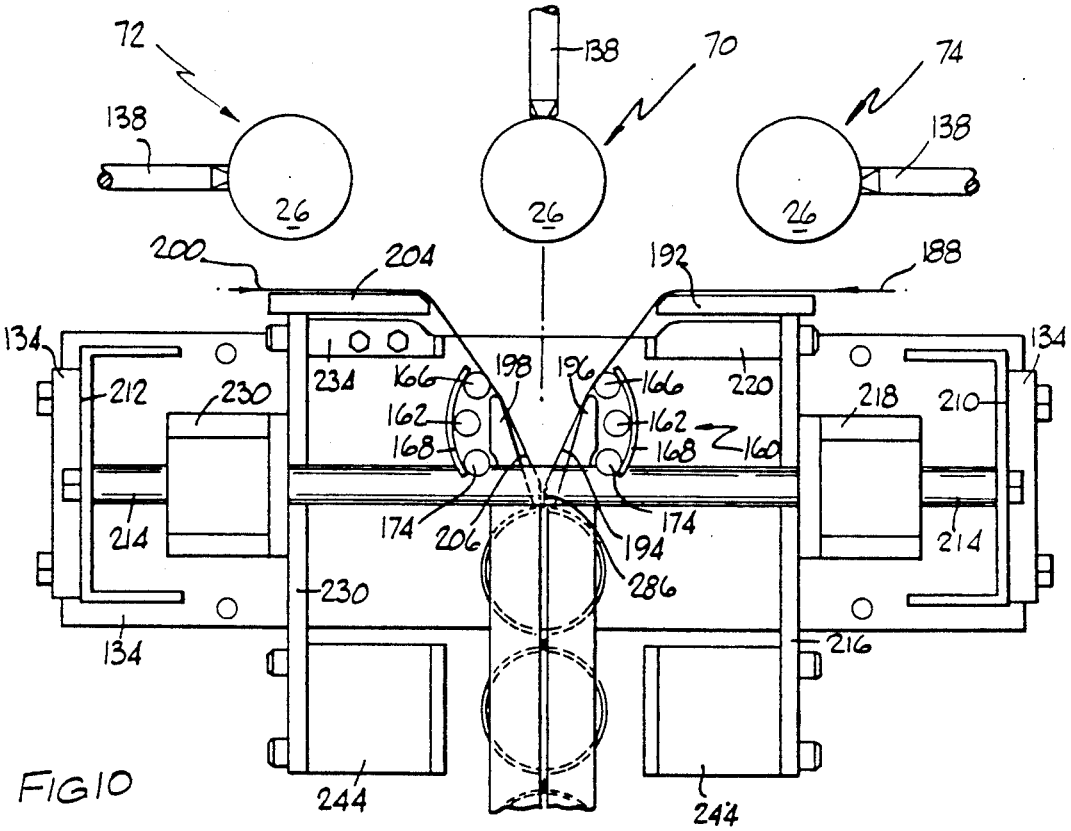
FIG. 10 is an enlarged side elevational view with parts removed of a portion of FIG. 3.
Figure 11:
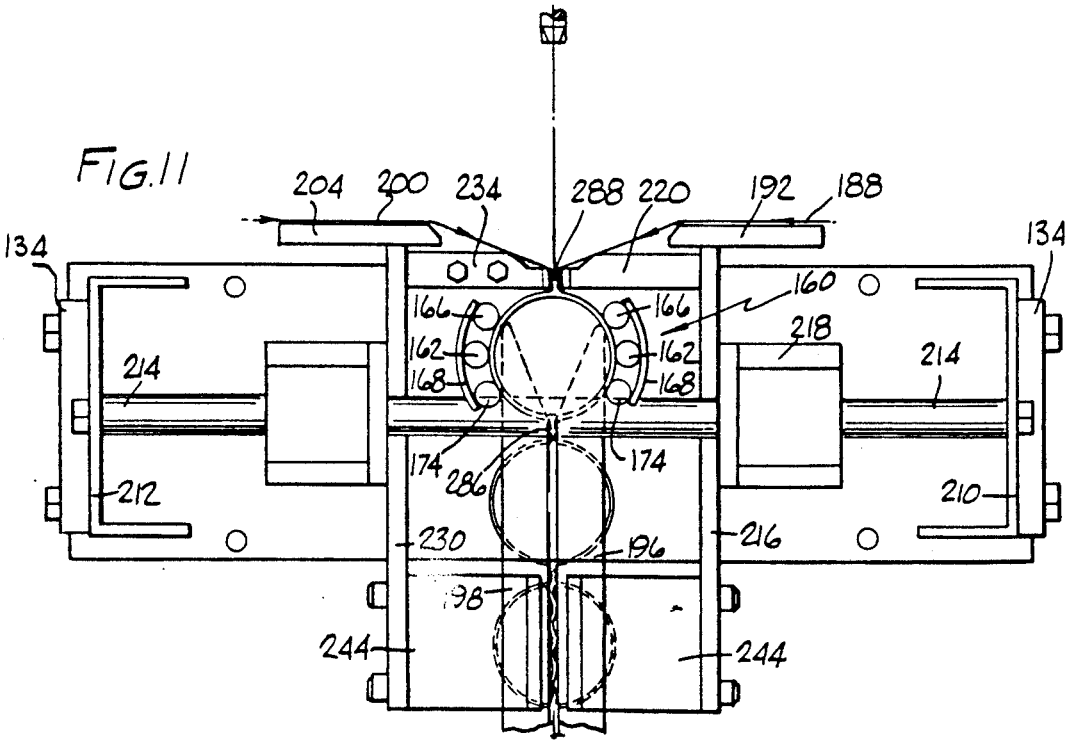
FIG. 11 is a view similar to FIG. 10 at a different step of the packaging operation.

The heat sealing apparatus comprises a pair of spaced apart support channels 210 and 212 which are mounted on the main support frame 134. A pair of spaced apart shafts 214 extend between and are secured to the support channels 210 and 212. A pair of spaced apart L-shaped support panels 216 are mounted on bearing blocks 218 which are mounted for sliding movement over the shafts 214. A first sealing bar 220 extends between and is mounted on the pair of support panels 216. Heat means 222 are provided to provide heat to the first sealing bar 220. An air cylinder 226 is mounted on the support channel 210 and is connected to the first sealing bar 220 by a clevis arrangement 228 so that movement of the air cylinder 226 moves the shelf means 192 and the first sealing bar 220 in a reciprocating linear movement over the shafts 214. Another pair of spaced apart L-shaped support panels 230 are mounted on bearing blocks 232 which are mounted for sliding movement over the shafts 214. A second sealing bar 234 extends between and is mounted on the support panels 230. Heat means 236 are provided to provide heat to the second sealing bar 234. An air cylinder 238 is mounted on the support channel 212 and is connected to the second sealing bar 234 by a clevis arrangement 240 so that movement of the air cylinder 238 moves the shelf means 204 and the second sealing bar 234 in a reciprocating linear movement over the shafts 214. A third pair of opposite sealing bars 242 are mounted on one of the support panels 216 and one of the support panels 230 and have sealing edges in a facing relationship. A fourth pair of opposite sealing bars 244 are mounted on the other of the support panels 216 and the other of the support panels 230. The third and fourth sealing bars 242 and 244 move with the first and second sealing bars 220 and 234. As illustrated in FIGS. 10 and 11, the guides 196 and 198 extend past the third and fourth sealing bars 242 and 244 and, as explained below, the opposite edge portions 194 and 206 are between the guides 196 and 198. The sealing bars 242 and 244 are heated by the heat means 222 and 236. As illustrated in FIG. 3, a pair of crimping rollers 246 are located to crimp together the portions of the continuous sheets 188 and 200 next adjacent to the opposite edge portions 194 and 206 extending out of the guides 196 and 198.

The packaging station 8 also has force applying means 260, FIG. 3, comprising a first pair of paddle wheels 262 and a second pair of paddle wheels 264 for reasons explained below. The paddle wheels 262 and 264 form pockets 266 which are designed to accommodate sealed compartments having a plurality of container lids 26 confined therein and apply a force thereto as explained below. A drive motor 268, FIG. 1, is connected to control means 120 and rotates the pairs 262 and 264 of paddle wheels through drive means 270. As illustrated in FIGS. 1 and 3, the pairs 262 and 264 of paddle wheels are operated out of sequence so that a pocket 266 exists in the pair 264 when no pocket exists in the pair 262 and vice versa.

The product formed by the apparatus described above is illustrated in FIG. 14 and comprises a plurality of sealed compartments 280 formed by widthwise extending sealing strips 282 and intersecting lengthwise extending sealing strips 284. A plurality of container ends 26 are confined in each sealed compartment 280.

The operation of the packaging station 8 is illustrated in FIGS. 3 and 10–12. The apparatus 2 is manually operated until at least one sealed compartment 280 is below the pair of paddle wheels 264. As illustrated in FIG. 10, the first and second continuous strips 188 and 200 are fed over the shelf means 192 and 204 and through the holding cage 160 until first sealed superposed portions 286 are located just below the holding cage 160. The edge portions 194 and 206 are located outside of the guide means 196 and 198 so that portions of the continuous sheets are between the guide means 196 and 198. The first 220, the second 234, the third pair 242 and the fourth pair 244 of sealing bars are in the opened position. An accumulated plurality of container ends are moved out of the central transfer station 70 and pushed into the holding cage 160 so that portions of the first and second continuous strips 188 and 200 are in contact with the rods 166, 162 and 174. In FIG. 11, the first 220 and the second 234 sealing bars 220 have been moved to a closed position. As the first 220 and second 234 sealing bars move toward the closed position, they wrap other portions of the first and second continuous strips 188 and 200 around the remaining portions of the accumulated plurality of container lids 26. Either of the first and second sealing bars 220 and 234 or both are heated so as to activate the thermally reactive adhesive of the first continuous strip 188 to seal together the second superposed portions 288 to form the widthwise extending sealing strip 282. At the same time, the third and fourth pairs of sealing bars 242 and 244 move to a closed position so that the crimped together portions of the first and second continuous sheets 188 and 200 next adjacent to the opposite edge portions 194 and 206 are located therebetween. Either one of the third and fourth pairs of sealing bars 242 and 244 or both are heated to seal together the crimped together portions therebetween to form the lengthwise extending sealing strips 284. After the sealing operations have been completed, the sealing bars are moved to the opened position and one of the pairs 262 or 264 applied a force on one of the sealed compartments 280 to pull the sealed compartment 280 out of the holding cage 160.

At periodic intervals, no accumulated plurality of articles are pushed from the central transfer cage 70 into the holding cage 160 so as to form one or more empty sealed compartments 290. One purpose for this is to sever the empty sealed compartment by a conventional cutting means 291 at the cutting station 10. Another purpose is for use at the palletizing station 12 as illustrated in FIG. 3. A pallet 292 is placed on an indexing conveyor 294. An empty sealed compartment 290 is located between the end of the pallet 292 and a finger 296 extending from an indexing conveyor 298. The pallet 292 is moved until the empty sealed compartment 290 is clamped between the end of the pallet 292 and the finger 296. Both indexing conveyors 294 and 298 move the pallet 292 and the finger 296 until at least two filled sealed compartments 280 are on the pallet 292. The finger 296 then moves to an out of the way position as indicated by the dotted lines in FIG. 3. The indexing conveyor 294 then moves the pallet 292 back and forth to form a plurality of superposed rows of filled sealed containers 280 on the pallet.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A package for holding a plurality of container ends comprising:

a first and a second elongated strip of relatively flexible material in superposed relationship;

superposed portions of said first and second elongated strips being sealed together at periodic intervals to form a plurality of spaced apart interconnected sealed compartments;

each of said sealed compartments having a plurality of container ends confined therein;

said first elongated strip comprising a material permitting passage of at least airborne solvents; and said second elongated strip comprising a material having portions thereof facing said first elongated strip formed from a thermally reactive sealing material.

2. A package as in claim 1 wherein said material forming said first elongated strip comprises:

a kraft paper.

3. A package as in claim 1 wherein said material forming said second elongate strip comprises:

a plastic coated kraft paper wherein said plastic comprises said thermally reactive sealing material.

4. A package as in claim 1 wherein said material forming said second elongated strip comprises:

a plastic material that comprises said thermally reactive sealing material.

* * * * *